US009394711B2

(12) United States Patent
Henkin et al.

(10) Patent No.: US 9,394,711 B2
(45) Date of Patent: Jul. 19, 2016

(54) POOL CLEANER POSITIVE PRESSURE WATER SUPPLY DISTRIBUTION SUBSYSTEM AND WALL FITTING

(71) Applicants: Melvyn L. Henkin, Ventura, CA (US); Jordan M. Laby, Ventura, CA (US)

(72) Inventors: Melvyn L. Henkin, Ventura, CA (US); Jordan M. Laby, Ventura, CA (US)

(73) Assignee: Henkin-Laby, LLC, Ventura, CA (US)

( * ) Notice: Subject to any disclaimer, the term of this patent is extended or adjusted under 35 U.S.C. 154(b) by 247 days.

(21) Appl. No.: 13/938,089

(22) Filed: Jul. 9, 2013

(65) Prior Publication Data

US 2014/0215730 A1 Aug. 7, 2014

Related U.S. Application Data

(60) Provisional application No. 61/690,990, filed on Jul. 10, 2012.

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
USPC ..... 210/167.15, 167.16, 167.17
See application file for complete search history.

(56) References Cited

U.S. PATENT DOCUMENTS

| | | | | |
|---|---|---|---|---|
| 3,605,131 | A * | 9/1971 | Brazel et al. | 4/491 |
| 5,985,156 | A | 11/1999 | Henkin | |
| 6,039,886 | A | 3/2000 | Henkin | |
| 6,090,219 | A | 7/2000 | Henkin | |
| 6,280,611 | B1 | 8/2001 | Henkin | |
| 6,294,084 | B1 | 9/2001 | Henkin | |
| 6,365,039 | B1 | 4/2002 | Henkin | |
| 6,387,250 | B1 | 5/2002 | Henkin | |
| 6,398,878 | B1 | 6/2002 | Henkin | |
| 6,485,638 | B2 | 11/2002 | Henkin | |
| 6,652,742 | B2 | 11/2003 | Henkin | |
| RE38,479 | E | 3/2004 | Henkin | |
| 7,318,448 | B2 | 1/2008 | Fleischer | |
| 7,501,056 | B2 * | 3/2009 | Henkin et al. | 210/167.17 |
| 8,266,752 | B2 | 9/2012 | Henkin | |
| 8,322,908 | B1 * | 12/2012 | Hartmann | 366/136 |

* cited by examiner

*Primary Examiner* — Fred Prince
(74) *Attorney, Agent, or Firm* — Arthur Freilich

(57) ABSTRACT

A cleaning system comprising a cleaner body configured to travel through a water pool powered by a positive pressure water flow supplied via a flexible hose. The system is characterized by:

(1) a water distribution subsystem carried by the cleaner body including a state valve selectively operable in a forward or redirect state and a mode valve selectively operable in a top or bottom mode; and/or (2) a wall fitting including an outlet section extending downward at an oblique angle between 15° and 75° to reduce the likelihood of hose restraint.

6 Claims, 12 Drawing Sheets

POOL CLEANER POSITIVE PRESSURE WATER SUPPLY DISTRIBUTION SUBSYSTEM AND WALL FITTING

RELATED APPLICATION

This application claims priority based on U.S. provisional application 61/690,990 filed on 10 Jul. 2012.

FIELD OF THE INVENTION

This invention relates to swimming pool cleaning systems comprised of a cleaner body adapted to be propelled by a positive pressure water source for travel through a swimming pool.

BACKGROUND OF THE INVENTION

Pool cleaning systems which include a cleaner body adapted to automatically travel through a swimming pool for cleaning debris from the pool water surface and/or containment wall surface are well known. A typical cleaner body is configured to be powered by a positive pressure water flow supplied via a flexible conduit from an electrically powered pump. The supplied water flow is typically directed by a water distribution subsystem carried by the cleaner body to nozzles oriented to discharge water jets to propel the cleaner body along a travel path through the pool. A typical water distribution subsystem functions primarily to propel the cleaner body in a first direction (i.e., forward state) in the pool and to occasionally redirect the cleaner body in a different, or second, direction (i.e., backup/redirect state). Occasional redirection of the cleaner body reduces the likelihood of it getting trapped behind an obstruction in the pool. The prior art also shows cleaning systems configured to cause the body to alternately operate at the water surface (top mode) and at the containment wall surface (bottom mode). Embodiments of such systems are described in various patents including U.S. Pat. Nos. 6,365,039; 7,318,448; 7,501,056.

More particularly, U.S. Pat. No. 6,365,039 describes various positive pressure cleaner embodiments each including a water distribution subsystem for discharging water flows to propel a cleaner body along a substantially random travel path. Such distribution subsystems generally include a valve assembly carried by the cleaner body which, in a forward state, directs a supplied water flow along a first interior path to produce forces on the body for moving it in a first direction or, in a backup/redirect state, along a second interior path to produce forces on the body to redirect it in a second direction different from the first direction. The embodiments described in Patent U.S. Pat. No. 6,365,039 typically employ a valve actuator for controlling a valve element mounted for reciprocal linear movement between first and second positions for respectively directing the supplied water flow along either the first or the second interior path.

U.S. Pat. No. 7,318,448 describes alternative water distribution subsystems employing a piston including a valve element mounted for movement between first and second positions for respectively discharging supplied pressurized water through different discharge jets to respectively propel the cleaner body in a first direction or a second direction.

U.S. Pat. No. 7,501,056 describes further alternative subsystem embodiments for discharging a supplied pressurized water flow through selected discharge jets and characterized by the use of a hydraulic actuator for moving a valve element between different first and second positions.

SUMMARY

The present invention is directed to an automatic pool cleaning system including a cleaner body configured to be powered by a positive pressure water flow supplied via a flexible conduit from an electrically driven pump. A cleaner body in accordance with the invention incorporates an enhanced water distribution subsystem characterized by an upstream state valve and a downstream mode valve. The state and mode valves are controlled to selectively direct the supplied positive pressure water flow out through discharge nozzles carried by the cleaner body to propel the body through the pool and alternately clean the pool water surface and the containment wall surface. The subsystem further includes a turbine driven by the supplied water flow to power a controller assembly for operating first and second actuators respectively controlling the state and mode valves. The state valve is selectively operable in a first (forward) state or a second (redirect) state. The mode valve is selectively operable in a first (top/water surface) mode or a second (bottom/wall surface) mode.

In a preferred exemplary embodiment of the invention, the controller assembly includes a gear train driven by the turbine to periodically switch the state valve between said forward state and said redirect state. Additionally, the gear train periodically switches the mode valve between said top/water surface mode and said bottom/wall surface mode. In an exemplary configuration which will be assumed herein unless otherwise indicated, the controller assembly causes the cleaner body to repeatedly execute approximately 24 minute cycles comprised of about 7.5 minutes of top mode operation and about 16.5 minutes of bottom mode operation. Moreover, the cleaner body will primarily operate in the forward state but will periodically switch, e.g., about once every 1.5 minutes, to the redirect state for a short interval.

To enhance the operational durability and reliability of the mode valve, it is preferable to configure the controller assembly so that any gears driving the mode valve turn very slowly, e.g., on the order of less than one revolution per minute (RPM). To achieve this degree of gearing down, a preferred controller assembly gear train incorporates one or more intermittent mechanisms, e.g., Geneva mechanisms or mutilated gears, i.e., a gear having teeth omitted from a portion of its periphery.

In accordance with a significant feature of the preferred embodiment, the state valve is configured so that in its first, or forward, state, it passes the supplied positive pressure water flow to the mode valve. On the other hand, when the state valve is in its second, or redirect, state, the supplied water flow is directed to one or more redirect discharge nozzles and flow to the mode valve is cut off.

The state valve in its forward state directs the positive pressure water flow to the mode valve which operates to selectively couple the flow to either a first outlet or a second outlet. The first outlet is coupled to one or more of said discharge nozzles for enabling the cleaner body to operate in the top mode for cleaning along the pool water surface. The second outlet is coupled to one or more discharge nozzles for enabling the cleaner body to operate in the bottom mode for cleaning along the pool wall surface.

A preferred mode valve in accordance with the invention includes a first valve element mounted between the mode valve inlet and the mode valve outlets and configured to be periodically switched by the controller assembly to alternately enable the top and bottom modes. Moreover, in accordance with a significant optional feature of the preferred mode valve, a manually operable override means is provided for enabling a user to selectively restrict operation of the cleaner body to either the top mode or the bottom mode.

In accordance with an important feature of the preferred embodiment, the durability and reliability of the mode valve and related actuation components are enhanced by assuring that the mode valve is switched only during the state valve redirect intervals, that is when the supplied positive pressure water flow is diverted by the state valve to the redirect discharge nozzles and no significant positive pressure water flows to the mode valve. Consequently, the unloaded mode valve can be switched easily and reliably with a simple mechanism.

A pool cleaning system in accordance with the invention is powered by a positive pressure water flow supplied to the cleaner body by an electrically driven pump via a flexible supply conduit, or hose. The pump outflow is generally coupled to the supply hose inlet via a wall fitting which typically extends into the pool terminating in either a vertically or horizontally oriented outlet section. It has now been recognized that both the horizontal and vertical orientations are somewhat problematic because each can occasionally restrain the free movement of the hose, and thus the cleaner body. In view of this recognition, a preferred wall fitting in accordance with the present invention is configured with the outlet section extending downwardly at an oblique angle intermediate the horizontal (0°) and vertical (90°) orientations, i.e., within a range between 15° and 75°, and preferably about 45°, relative to the adjacent wall surface, to reduce the likelihood of the hose being restrained. Although the preferred wall fitting is particularly advantageous when used with a top/bottom cleaning system, it can also be advantageously employed with other types of cleaning systems, e.g., top only or bottom only.

DETAILED DESCRIPTION

Figure 1:
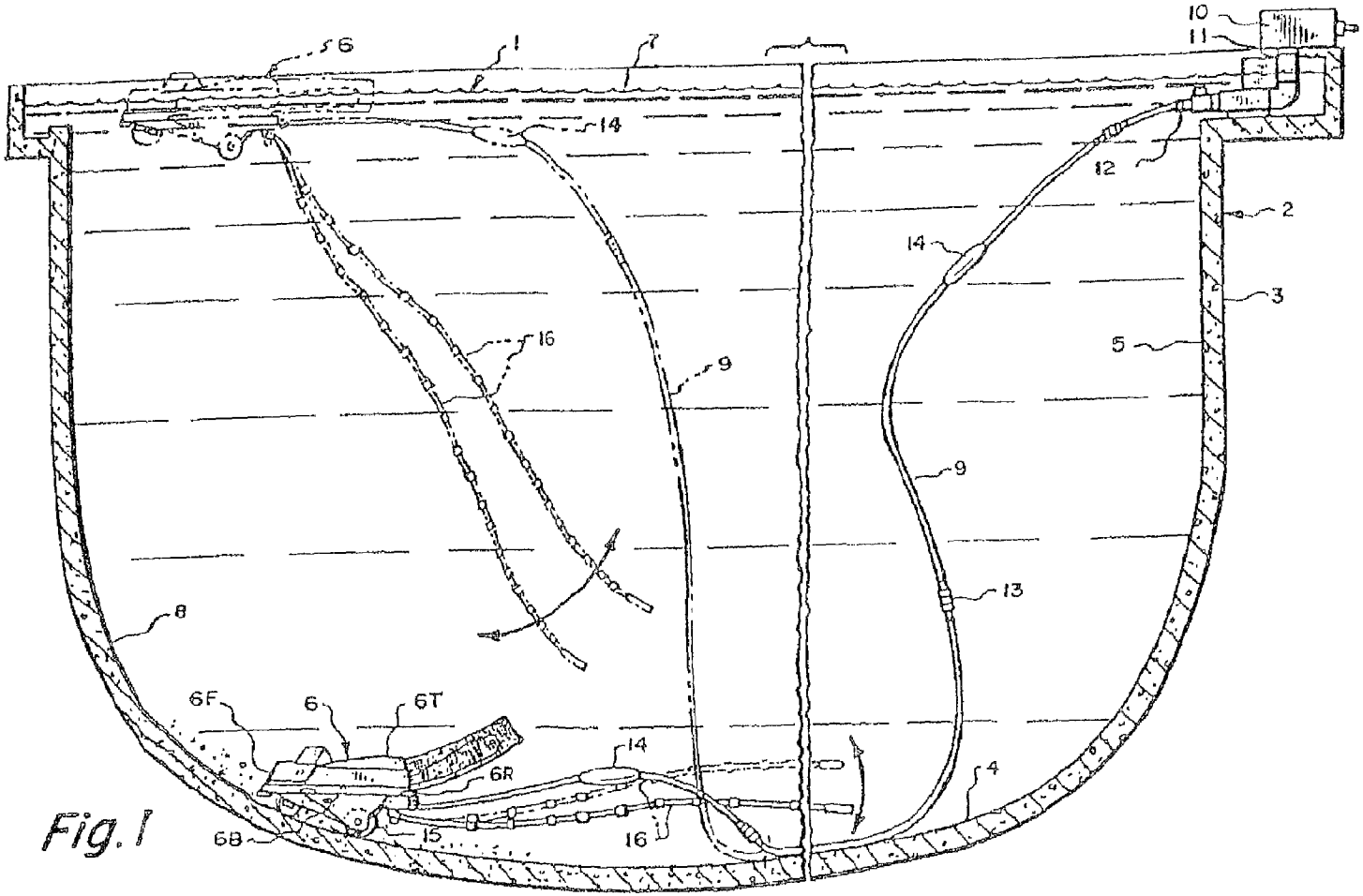
Fig. 1 PRIOR ART
FIG. 1 depicts a prior art pool cleaner body (substantially corresponding to FIG. 1 of U.S. Pat. No. 6,365,039) adapted to be propelled along a travel path proximate to the wall surface and/or the water surface.

Attention is initially directed to FIG. 1 which essentially corresponds to FIG. 1 of U.S. Pat. No. 6,365,039 whose disclosure is by reference incorporated herein. FIG. 1 illustrates a system for cleaning a water pool 1 contained in an open vessel 2 defined by a containment wall 3 having bottom 4 and side 5 portions. The system of FIG. 1 includes a cleaner body 6 configured for immersion in and travel through the water pool 1 for cleaning the interior wall surface 8 (bottom/wall surface mode) and the water surface 7 (top/water surface mode).

The cleaner body 6 preferably comprises an essentially rigid structure having a hydrodynamically contoured exterior surface for efficient travel through the water. Although the body 6 can be variously configured it is intended that it be relatively compact in size, preferably fitting within a two foot cube envelope. FIG. 1 depicts a heavier-than-water body 6 which in its quiescent or rest state typically sinks to a position (represented in solid line) proximate to the bottom of the pool 1. For operation in the top water surface mode, a vertical force is produced to lift the body 6 to the water surface 7 (represented in dash line). Alternatively, body 6 can be configured to be lighter-than-water such that in its quiescent, or rest state, it floats proximate to the water surface 7 requiring that a vertical force be produced to cause the lighter-than-water body to descend to the pool bottom for operation in the wall surfaced mode.

The body 6 is configured to be propelled along a travel path through the pool 1 powered by a positive pressure water flow supplied via flexible hose 9 from an electrically driven motor/pump assembly 10. The assembly 10 defines a pressure side outlet which is coupled via a wall fitting 12 to the flexible hose 9. The hose 9 can be formed of multiple sections, which can include flexible and stiff sections, coupled in tandem by hose fasteners and swivels 13.

As represented in FIG. 1, the body 6 generally comprises a top portion or frame 6T and a bottom portion or chassis 6B, spaced in a nominally vertical direction. The body also generally defines a front or nose portion 6F and a rear or tail portion 6R spaced in a nominally horizontal direction. The body is supported on traction means such as wheels 15 which are mounted for engaging the wall surface 8 when operating in the bottom/wall surface cleaning mode.

Figure 2:
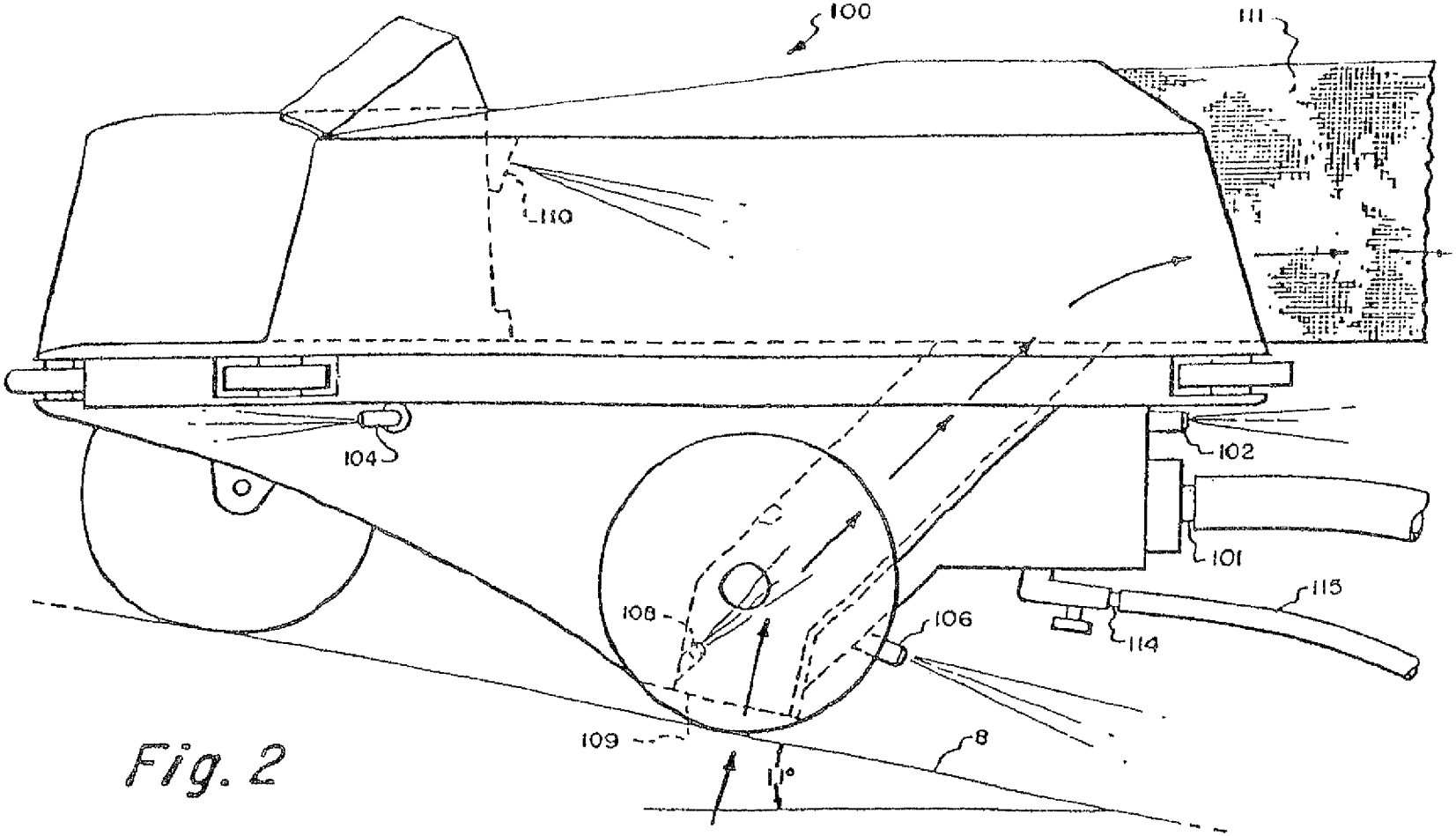
Fig. 2 PRIOR ART
FIG. 2 is similar to FIG. 2 of U.S. Pat. No. 6,365,039 and schematically depicts a side view of an exemplary prior art pool cleaner body.

Attention is now directed to FIG. 2 which substantially corresponds to FIG. 2 of U.S. Pat. No. 6,365,039 and schematically depicts a cleaner body 100 having a positive pressure water supply inlet 101 and multiple water outlets which are variously used by the body 100 in its different modes and states. The particular outlets active during the forward travel state (for both top and bottom modes) and during the redirect travel state in accordance with the present invention are respectively shown in FIGS. 3A-3D.

With reference to FIG. 2, the following water outlets are depicted:

102—Forward Thrust Jet; provides forward propulsion and a downward force in the wall surface cleaning mode to assist in holding the traction wheels 15 against the wall surface 8.

104—Redirect ("backup") Thrust Jet; provides backward propulsion and rotation of the body around a vertical axis when in the redirect state;

106—Forward Thrust/Lift Jet; provides thrust to lift the cleaner body to the water surface and to hold it there and propel it forwardly when operating in the top water surface mode;

108—Vacuum Jet Pump Nozzle; produces a high velocity jet to create a suction at the vacuum inlet opening 109 to pull in water and debris from the adjacent wall surface 8 in the bottom wall surface mode;

110—Skimmer Jets; provide a flow of surface water and debris into a debris container 111 when operating in the water surface cleaning mode;

114—Sweep Hose; discharges a water flow through hose 115 to cause it to whip and sweep against wall surface 8.

Figure 3C:
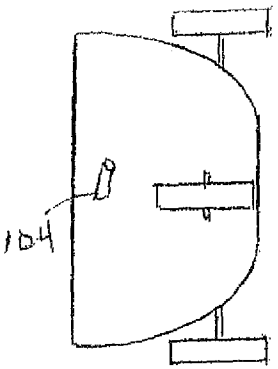
FIGS. 3A, 3B, 3C, 3D schematically illustrate respective top, side, front, and rear views of a pool cleaner body showing a preferred configuration of nozzles for discharging respective water flows to selectively propel the body along a travel path at the pool wall surface or water surface and to redirect the body's travel path.
Figure 3A:
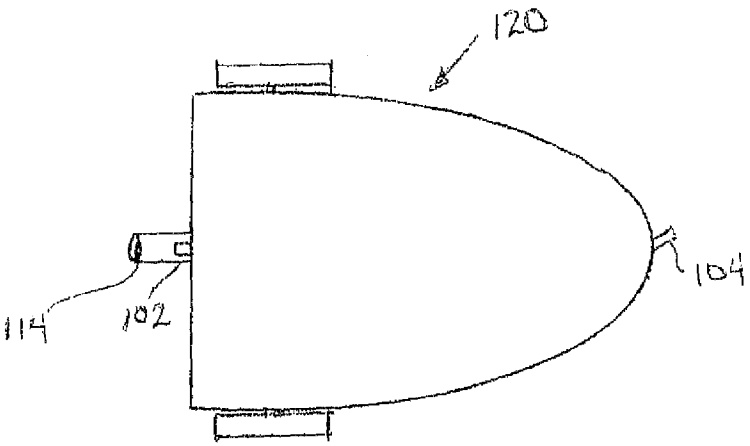
Figure 3B:
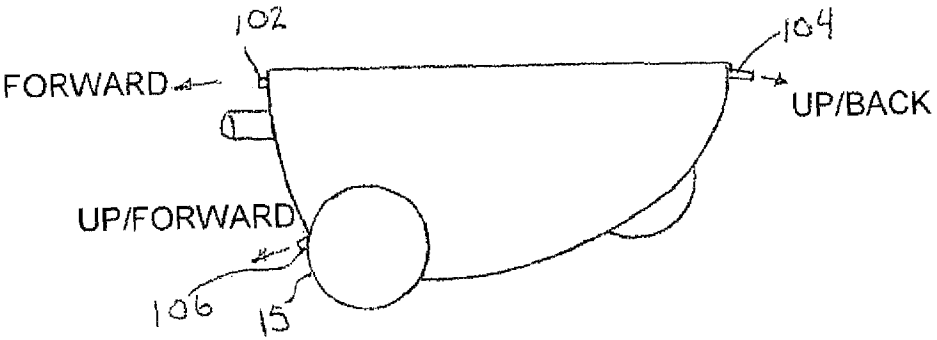
Figure 3D:
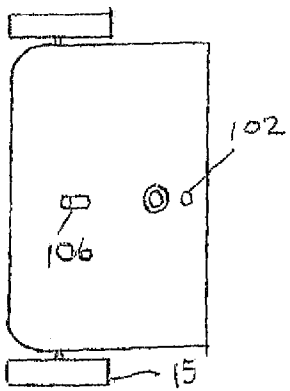

Attention is now directed to FIGS. 3A, 3B, 3C, and 3D which schematically illustrate top, side, front, and rear views of an exemplary cleaner body 120 which can incorporate a water distribution subsystem in accordance with the present invention. These figures show the water outlets used for discharging water jets to produce forward and redirect movement during the bottom/wall surface mode and/or the top/water surface mode. Note initially that FIGS. 3A, 3B, and 3D illustrate a discharge nozzle 102 for discharging a water jet during wall surface operation oriented substantially along the longitudinal centerline of the body 120, to produce a force on the body to both propel it in a first or forward direction and press wheels 15 against the wall surface 8.

FIGS. 3B and 3D illustrate a second nozzle 106 mounted at the rear of body 120 below the nozzle 102 but also substantially aligned with the longitudinal center line of the body 120. Note that the nozzle 106 is oriented to discharge a water jet rearwardly and downwardly to produce a vertical force for lifting the body 120 to the water surface and a forward thrust for propelling the body along the water surface. The jet discharged from nozzle 106 acts to maintain the body at the water surface while propelling it forwardly in the forward travel state while operating in the top/water surface mode.

Further note redirect nozzle 104 in FIGS. 3A, 3B, 3C. The nozzle 104 is active during the redirect state to redirect the travel path of the body 120 and enable it to avoid being trapped by obstructions in the pool. More particularly, note in FIG. 3A that nozzle 104 mounted at the front of body 120 is oriented to discharge a water jet having a horizontal component extending to the left. The forces attributable to the discharge from nozzle 104 act to produce a turning moment around the body's center of gravity to rotate the body in a clockwise direction so that it can later resume forward travel along a redirected path. In order to facilitate rotation of the body 120 when operating in the wall surface mode with traction wheels 15 engaged against wall surface 8, it is preferable that the body be lifted slightly to disengage the wheels 15 from the wall surface. Accordingly, the nozzle 104 is preferably oriented so that the jet discharged therefrom has a vertical component acting to lift the body and wheels 15 from the wall surface. It should also be noted that the nozzle 104 is oriented so that the jet discharged therefrom has a forward component to produce a force acting to cause the body to move rearwardly, i.e., backup, to facilitate the body extricating itself from behind an obstruction. Thus, it should be appreciated that when the cleaner body is operating in the redirect state, the water jet discharged from nozzle 104 preferably causes the body to backup, lift, and rotate to free the body from an obstruction and modify or redirect its travel path.

Figure 4A:
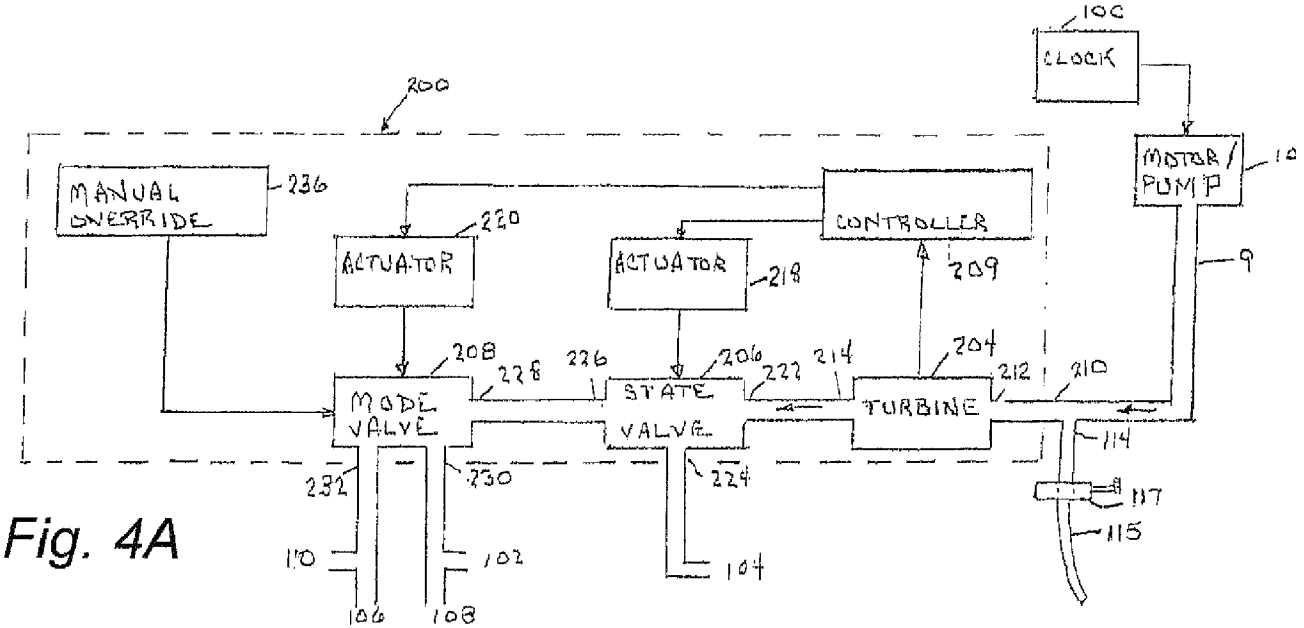
FIG. 4A is a functional block diagram depicting a water distribution subsystem in accordance with the invention showing a serially coupled upstream state valve and downstream mode valve for selectively directing water flows to respective discharge nozzles in the forward travel state and the redirect travel state.

Attention is now directed to FIG. 4A which comprises a block diagram depicting a preferred water distribution subsystem 200 in accordance with the present invention. The subsystem 200 is preferably installed in the cleaner body 120 for selectively distributing a positive pressure water flow supplied via hose 9, to the aforementioned nozzles 102, 104, 106, 108, 110. In a typical installation, positive pressure water is supplied to hose 9 by the motor/pump 10 which is preferably time activated by a clock mechanism 10C.

The subsystem 200 is comprised primarily of a turbine 204, a state valve 206 located downstream from the turbine 204, a mode valve 208 located downstream from the state valve 206, and a controller assembly 209 for controlling the state and mode valves. The hose 9 supplies a positive pressure water flow to a subsystem inlet port 210 and to the entrance 212 of turbine 204. The water flow rotates the turbine, e.g., a paddle wheel, and exits at port 214. The turbine 204 drives the controller 209 which controls a state valve actuator 218 and a mode valve actuator 220 in a manner to be discussed hereinafter. The turbine exit port 214 is coupled to the entrance 222 of state valve 206 which operates in either a forward state to direct the supplied water flow to exit port 226 or a redirect state to direct the water flow to exit port 224. As depicted in FIG. 4A, exit port 224 feeds the aforementioned nozzle 104 which produces the redirect thrust jet whereas exit port 226 feeds the entrance 228 of mode valve 208. Mode valve 208 operates in either a bottom/wall surface mode to direct the water flow supplied thereto to exit port 230 or a top/water surface mode to direct the water flow to exit port 232. As indicated in FIG. 4A, exit port 230 feeds aforementioned nozzles 102 and 108 respectively producing the forward thrust jet and the vacuum jet. Exit port 232 feeds aforementioned nozzles 106 and 110 respectively producing the forward thrust/lift jet and the skimmer jet.

FIG. 4A also depicts a manual override control 236 which operates in conjunction with the mode valve 208 to allow a user to selectively set the mode valve 208 to one of three positions; i.e., a first position which allows the valve to sequentially switch between the bottom and top modes, a second position which maintains the valve in the top mode, and a third position which maintains the valve in the bottom mode. FIG. 4A also shows the sweep hose 115 adapted to receive a water stream from outlet 114 via a manually adjustable valve 117.

In use, the turbine 204 is driven for so long as the motor/pump 10 supplies a positive pressure water flow to turbine entrance 212. The turbine 204 drives controller assembly 209 to control state valve actuator 218 and mode valve actuator 220. In an exemplary embodiment which will be assumed herein unless otherwise indicated, the controller assembly will operate actuator 220 to cause the mode valve 208 to repeatedly execute approximately 24 minute cycles each comprised of about 7.5 minutes of top mode operation (i.e., water flow out of exit port 232) and about 16.5 minutes of bottom mode operation (i.e., water flow out of exit port 230). Additionally, the controller assembly 209 controls actuator 218 to cause state valve 206 to operate primarily in the forward state (i.e., water flow out of exit port 226 to mode valve entrance 228) but to periodically switch (e.g., every 1.5 minutes) to the redirect state for a short interval (i.e., water flow out of exit port 224 to nozzle 104).

Figure 4B:
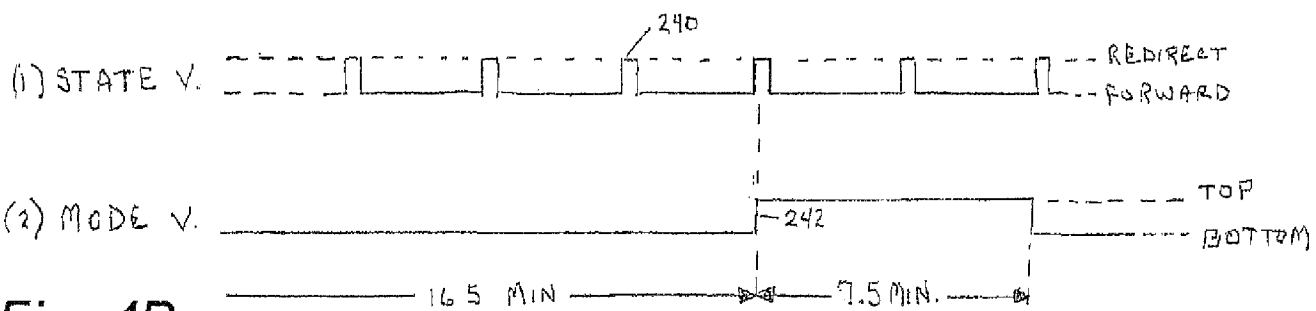
FIG. 4B is a timing diagram showing exemplary relative switching times for the state and mode valves of FIG. 4A.

FIG. 4B is a timing diagram depicting an exemplary operation of the subsystem of FIG. 4A. Line (1) of FIG. 4B depicts the operation of the state valve 206 showing that it resides primarily in the forward state but periodically switches to the redirect state (e.g., every 1.5 minutes) for a short interval (e.g., 10 seconds) as represented by time intervals 240. Line (2) of FIG. 4B shows that mode valve 208 resides in the bottom mode for about 16.5 minutes and then switches at 242 to the top mode for about 7.5 minutes. In accordance with a significant feature of a preferred embodiment, the mode valve switching transition 242 occurs during a redirect interval defined by state valve 206. During a redirect interval, the mode valve 208 is not loaded by any supplied positive pressure water flow. By restricting mode valve switching to such unloaded intervals, the mode valve 208 and actuator 220 mechanisms can be simply implemented while assuring reliable long term operation.

Figure 5:
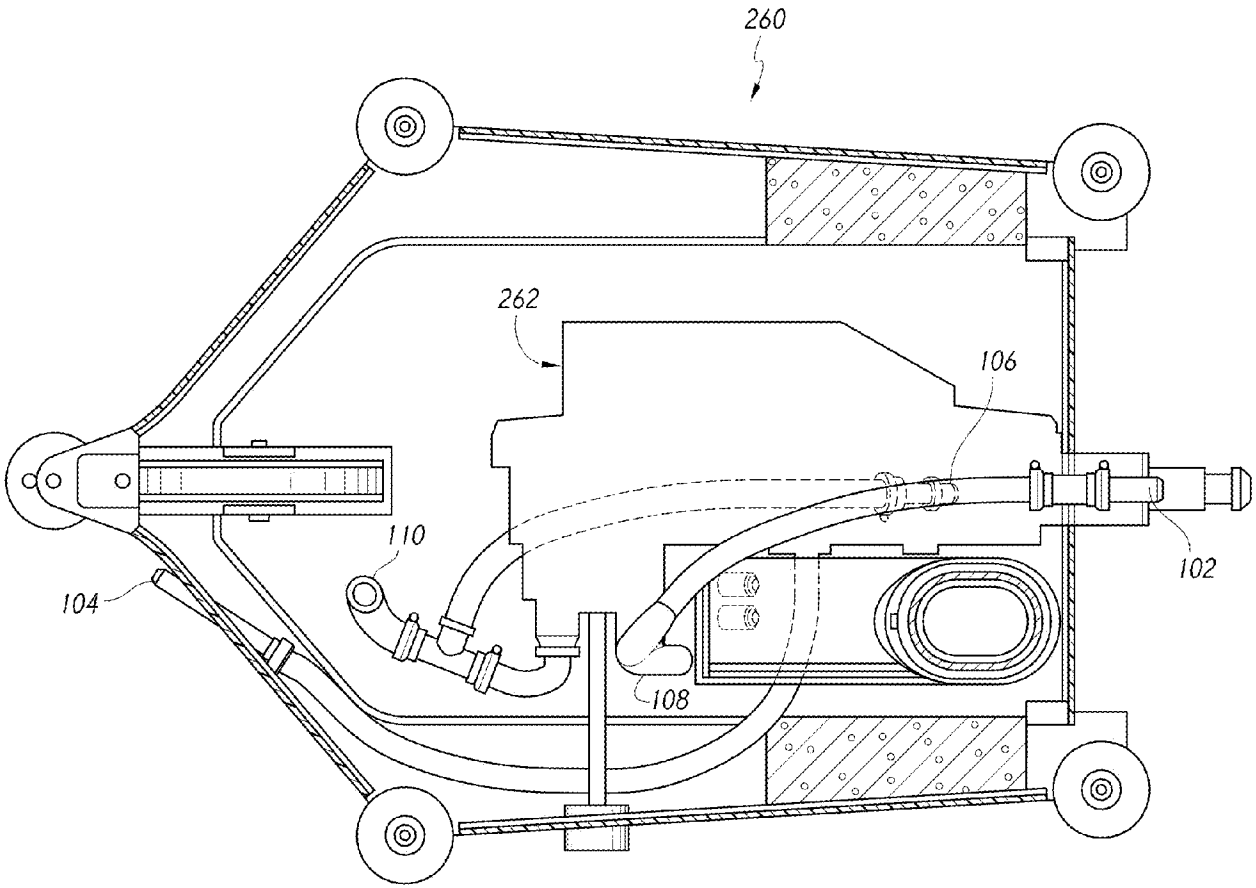
FIG. 5 is a plan view of a cleaner body with its top portion removed to show the placement of a water distribution subsystem in accordance with the invention.
Figure 6A:
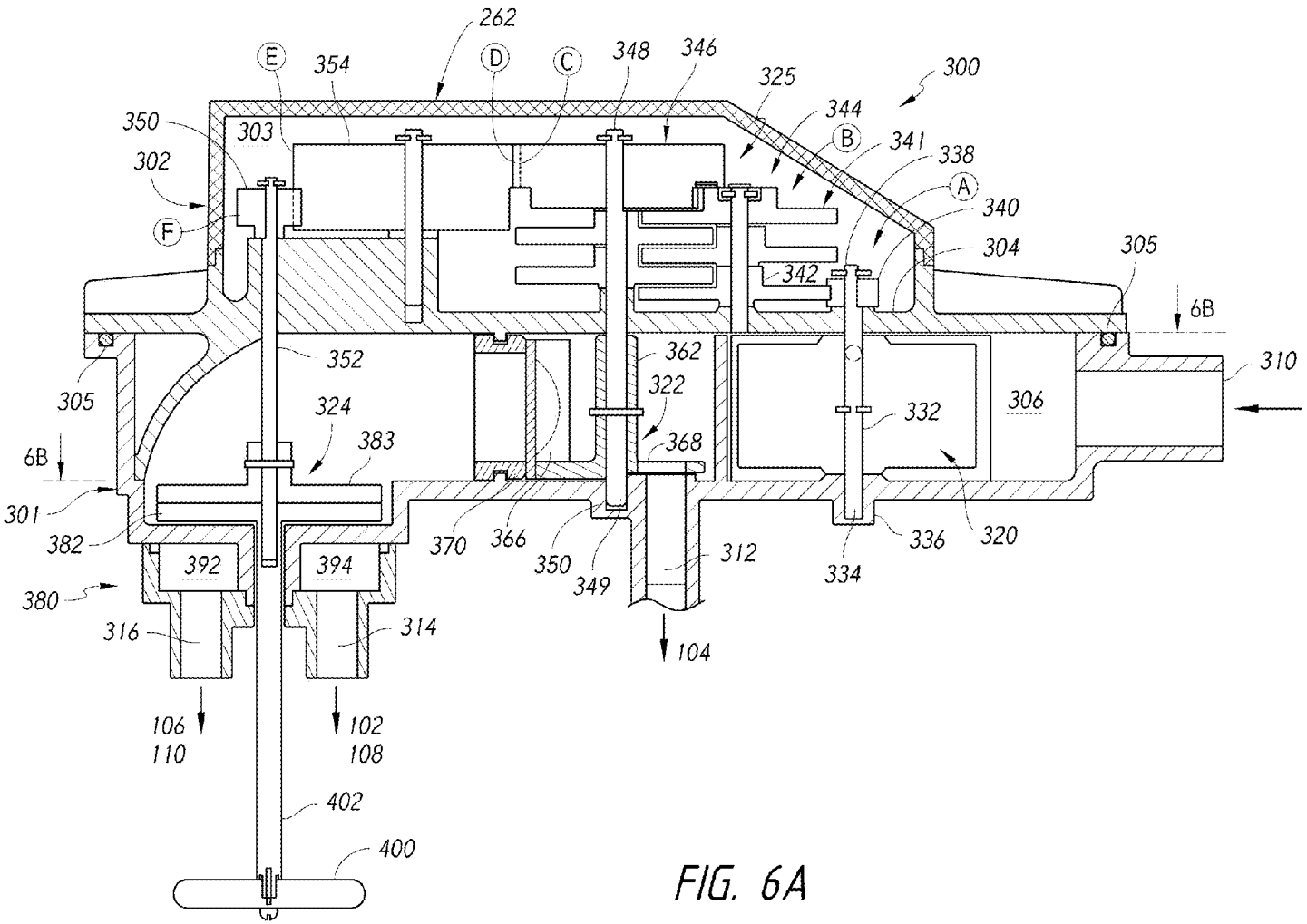
FIG. 6A is a horizontal sectional view through the subsystem of FIG. 5.
Figure 6B:
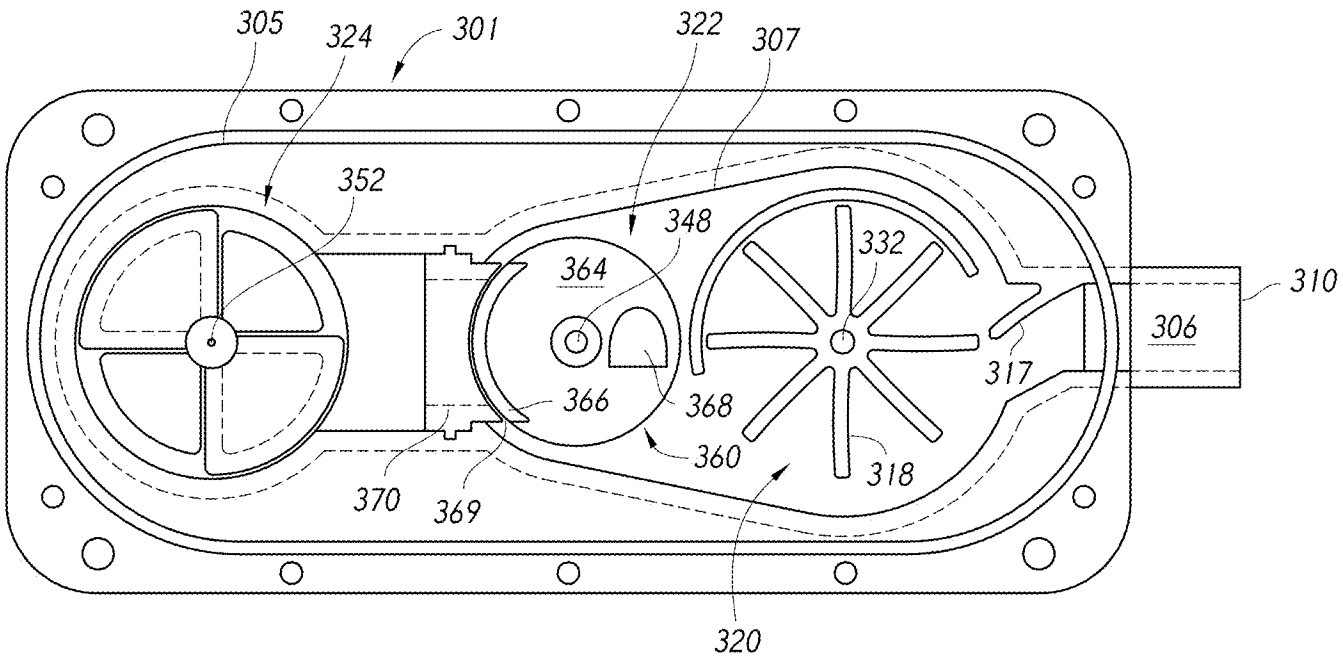
FIG. 6B is a schematic sectional view taken substantially along the plane 6B-6B of FIG. 6A.

Attention is now directed to FIG. 5 which shows a plan view of the bottom portion of a cleaner body 260 embodying a water distribution subsystem 200 in accordance with the present invention. FIG. 5 illustrates a housing 262 mounted in the cleaner body 260 for accommodating the various physical components of the water distribution subsystem 200 schematically represented in FIG. 4A FIGS. 6A and 6B are sectional views illustrating the physical configuration of a preferred water distribution subsystem embodiment 300 mounted in housing 262. Note that the housing 262 includes a lower portion 301 and an upper portion 302 defining a compartment 303 above a floor 304. The lower surface of floor 304 is configured to seal against an O-ring 305 to define an interior compartment containing a passageway or flow path 306 contained by a wall 307 (FIG. 6B). The flow path 306 extends from an inlet port 310 to exit ports 312, 314, 316. The flow path 306 includes deflector surfaces 317 for directing a water flow entering port 310 against the blades 318 of an upstream turbine 320. A state valve 322 is located downstream from the turbine for directing a supplied water flow either to exit port 312 or further downstream to a mode valve 324. The mode valve 324 functions to selectively direct a supplied water flow either to exit port 314 or exit port 316. The aforementioned compartment 303 accommodates a controller assembly 325 to be discussed in detail hereinafter.

With continuing reference to FIGS. 6A and 6B, it should be appreciated that positive pressure water supplied to inlet port 310 (from pump 10) will rotate the paddle wheel/turbine 320 and its shaft 332. Note that shaft 332 has a first end 334 mounted for rotation in bearing 336 and a second end 338 extending into compartment 303. Note that shaft end 338 carries a drive gear 340 for driving the controller assembly 325. Although the controller assembly can be implemented in a variety of ways, e.g., mechanical, electronic, it will initially be assumed to be implemented by a gear train 341 in which gear 340 engages gear 342 of gear set 344. Gear set 344 is configured to drive gear set 346 which with shaft 348 comprises an actuator for controlling the aforementioned state valve 322. Gear set 346 is configured to drive gear 350 and shaft 352 via intermediate gear 354. Gear 350 and shaft 352 comprise an actuator for controlling the aforementioned mode valve 324.

Figure 6C:
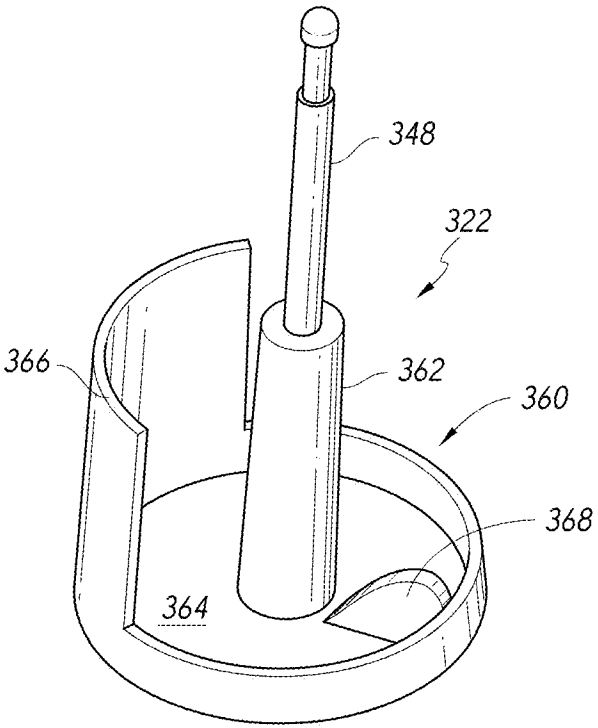
FIG. 6C is an isometric view of the state valve shown in FIG. 6A.
Figure 6D:
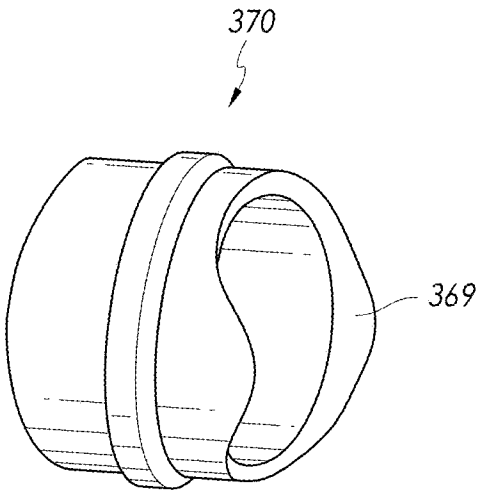
FIG. 6D is an isometric view of the valve seat element shown in FIGS. 6A and 6B.

FIG. 6C illustrates a preferred structure for state valve 322. Note that state valve 322 comprises a valve body 360 having a collar 362 extending axially from a circular floor 364. An arcuate wall 366 extends axially from the floor 364 and is mounted coincident with a peripheral portion of the floor. An aperture 368 is formed in the floor 364 located approximately diametrically opposite to the midsection of the arcuate wall 366. The aforementioned state valve shaft 348 extends into collar 362 and is fixed for rotation therewith. The shaft lower end 349 rotates in bearing 350.

In operation, assume that the controller assembly 325 driven by paddle wheel 320 rotates the state valve shaft 348 and floor 364 through one full cycle every 1.5 minutes. For a short portion of each cycle, aperture 368 will align with exit port 312 while arcuate wall 366 will seal against a forward edge 369 of valve seat 370 to block any water flow to the downstream mode valve 324. This situation directs the supplied water flow through exit port 312 to nozzle 104 for discharging a water jet to produce the aforementioned redirect action for a short interval, e.g., 10 seconds, as represented by 240 in FIG. 4B. During the remainder of the cycle, exit port 312 stays closed, wall 366 disengages from valve seat 370, and the supplied water flow moves past the state valve 322 to the mode valve 324.

Figure 6E:
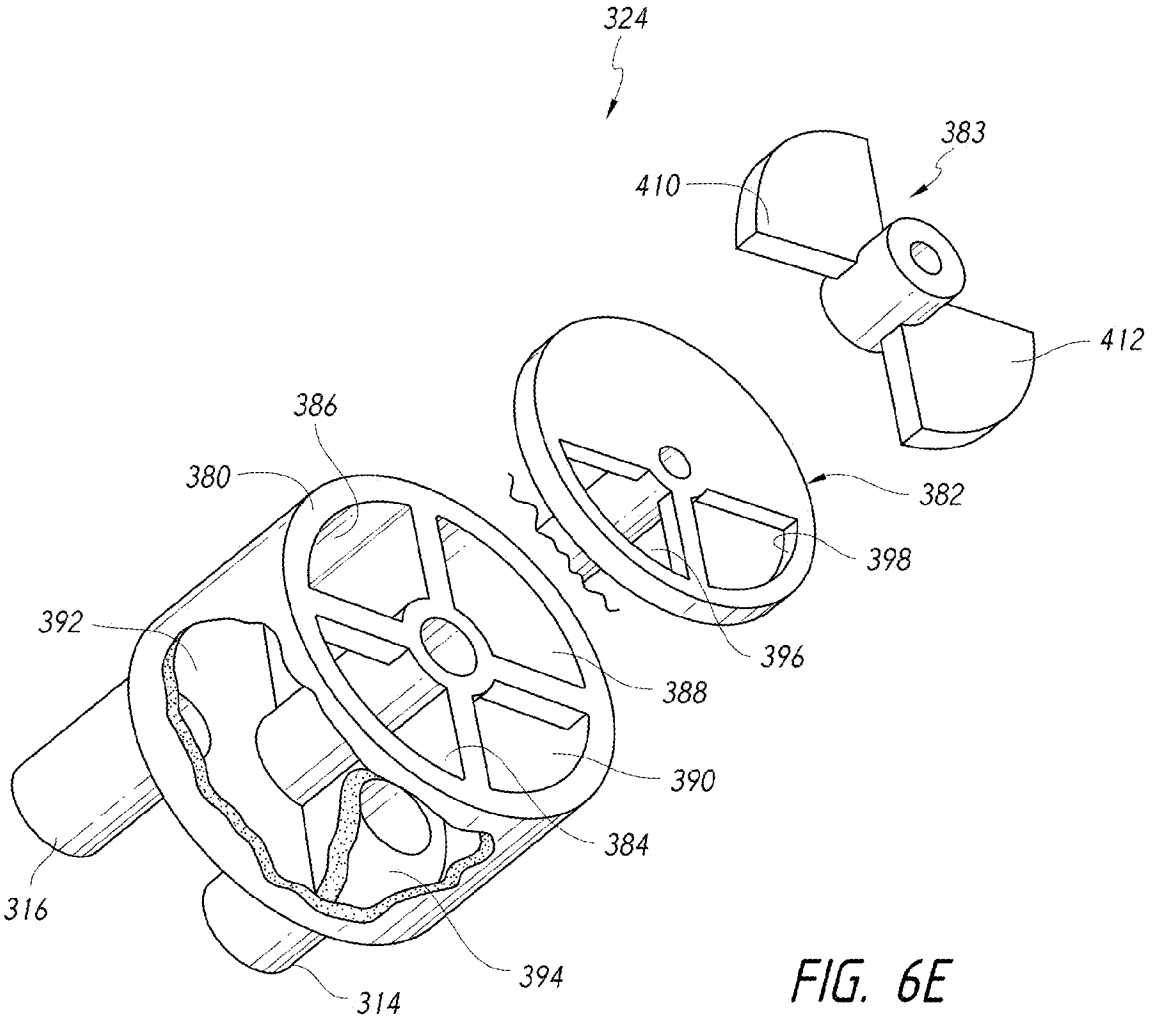
FIG. 6E is an isometric exploded view of the mode valve shown in FIG. 6A.

Attention is now directed to FIG. 6E which illustrates a preferred structure for the mode valve 324. The mode valve is primarily comprised of a base plate 380, a manually controlled override disk 382, and a valve disk 383 adapted to be driven by the controller assembly 325. The base plate 380 defines four separate quadrant openings 384, 386, 388, 390. Openings 384 and 386 are positioned to direct water to nozzles 106 and 110 for top mode operation via chamber 392 and aforementioned exit port 316 (FIG. 6A). Openings 388 and 390 communicate with nozzles 102 and 108 for bottom mode operation via chamber 394 and aforementioned exit port 314.

The override disk 382 defines only two quadrant openings 396 and 398 and its orientation is adjustably controlled by a manually operable knob 400 and shaft 402 (FIG. 6A). The disk can be manually rotated by knob 400 to either a first (automatic) position, a second (top mode only) position, or a third (bottom mode only) position. In the first automatic position, the disk 382 aligns opening 396 with one of the base plate top mode openings 384, 386 while opening 398 is aligned with one of the base plate bottom mode openings 388, 390. In the second top only position, disk openings 396, 398 both align with base plate top mode openings 384, 386. In the third bottom only position, disk openings 396, 398 both align with base plate bottom openings 388, 390.

The valve disk 383 is mounted on shaft 352 (FIG. 6A) and is comprised of two or more sector valve elements 410, 412. As the shaft 352 is rotated by the controller assembly 325, the valve elements 410, 412 wipe across override disk 382 to periodically open the path through override disk openings 396 and 398. If the override disk 382 is in the first (automatic) position, the water flow from path 302 will alternately supply exit ports 314 and 316 thus alternately producing bottom and top mode operation. If the override disk 382 is in the second top only position, water will only flow to exit port 316 for top mode operation. Similarly, if the override disk 382 is in the third bottom only position, water will only flow to exit port 314 for bottom mode operation 316.

The controller assembly 325 can be implemented in a variety of ways such as by using gears or electronic timing circuitry. Regardless, for the exemplary operation assumed herein, the controller assembly will cause the state valve 322 to cycle about once every 1.5 minutes and the mode valve 324 to cycle about once every 24 minutes while providing about a 16.5 minute bottom mode dwell and a 7.5 minute top mode dwell during each cycle. It should be understood that this assumed timing is exemplary only and different durations can be selected to optimize the cleaning operation.

Figure 6F:
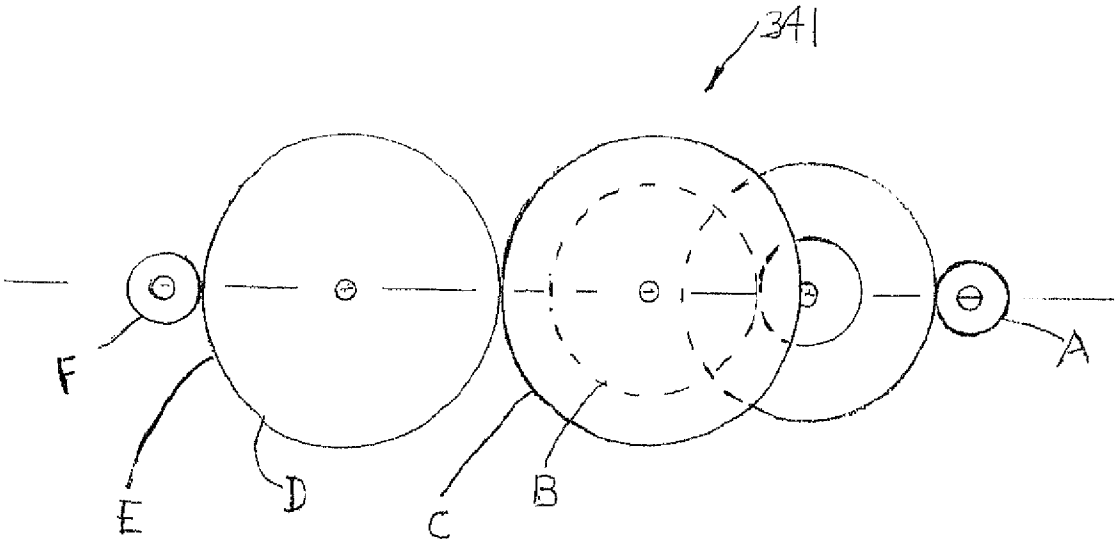
FIG. 6F is a schematic sectional view through the gear train of FIG. 6A controller assembly.

FIGS. 6A and 6F depict one preferred controller assembly implementation using a gear train 341 comprised of primary gears A, B, C, D, E, F. Gear A corresponds to a aforementioned drive gear 340 and gear F corresponds to aforementioned gear 350. All of the gears A-F are preferably 32 pitch gears. Drive gear A rotates gear B via a gear reduction set 344. Gears B and C rotate together. Gear C is preferably a mutilated gear with a 1.5 inch pitch diameter with three uninterrupted teeth, in one location, that engage gear D when the state valve 322 is in its mid redirect position. Gear D is a 48 tooth gear. Each time the state valve makes one revolution, gear D makes $1/16^{th}$ of a revolution. Gears D and E rotate together. Gear E is a mutilated gear with a 1.5 inch pitch diameter having three uninterrupted teeth, in each of two separate locations, that engage gear F and produce two separate mode valve dwell periods. That is, the respective gaps between the separate locations can have space for 14 and 28 absent teeth, respectively, for approximately producing the desired 7.5 minute duration for top mode operation and the 16.5 minute duration for bottom mode operation. Gear F is a 12 tooth gear that rotates the mode valve disk 383 by 90° for each mode change.

In accordance with a significant feature of the present invention, gear F motion occurs only when the state valve defines the redirect state and the mode valve 324 is receiving little to no water from the state valve 322. Therefore, the unloaded mode valve can switch modes very easily with a simple mechanism. All the gears driving the mode valve turn very slowly (less than one RPM). This feature greatly increases the durability and reliability of the entire controller assembly 325.

Figure 7A:
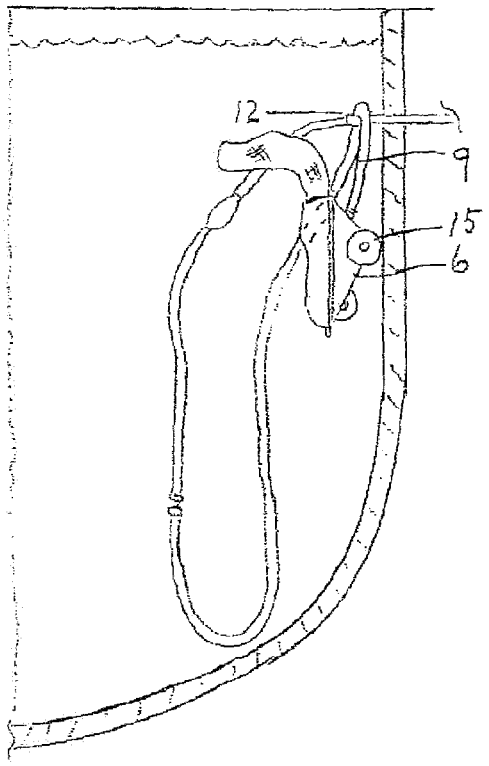
FIG. 7A is a side view showing a cleaner body being impeded by a wall fitting extending horizontally into a pool substantially perpendicular to the containment wall surface.
Figure 7B:
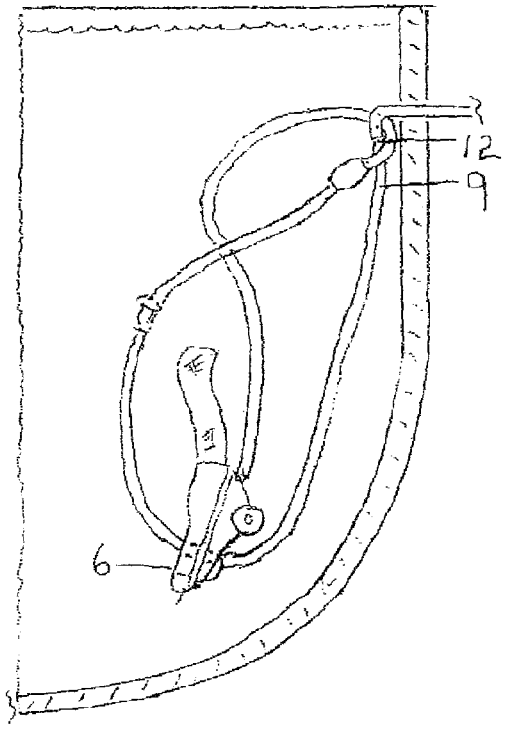
FIG. 7B is a side view showing a cleaner body being impeded by a wall fitting extending vertically into a pool substantially parallel to the containment wall surface.

In a typical prior art pool cleaning system, as exemplified by FIG. 1, a positive pressure water flow is supplied to the cleaner body 6 via a rigid wall fitting 12 and a flexible hose 9. In many installations, the fitting 12 projects horizontally into the pool, i.e., perpendicular to the adjacent wall surface. In other installations, the fitting may incorporate a right angle bend so as to extend vertically downward parallel to the wall surface. Both the horizontal and vertical orientations have been found to be somewhat problematic because each can occasionally restrain the free movement of the hose, and thus the free movement of the cleaner body 6. More particularly, note FIG. 7A which demonstrates how the hose 9 can drape around and get stuck on the horizontally extending fitting 12 after the body 6 and hose pass over the fitting. FIG. 7B shows how the hose 9 can get caught and stuck behind the vertically extending fitting 12.

Figure 8A:
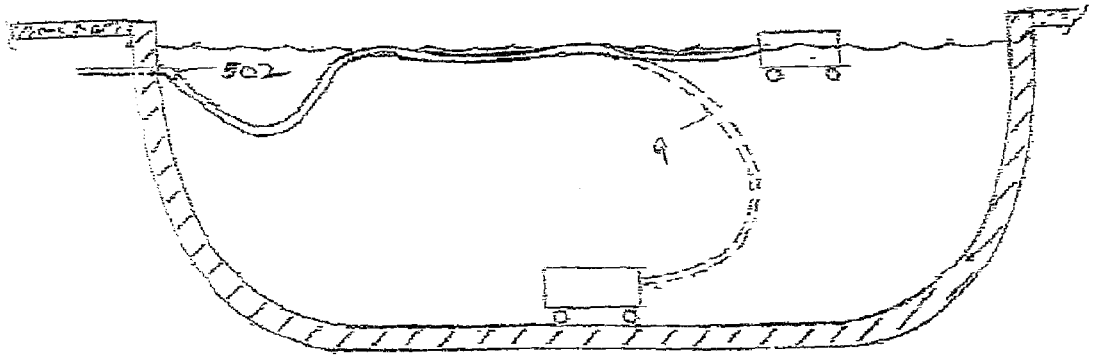
FIG. 8A is a side view showing a wall fitting extending into the pool at a downward oblique angle in accordance with the invention.
Figure 8B:
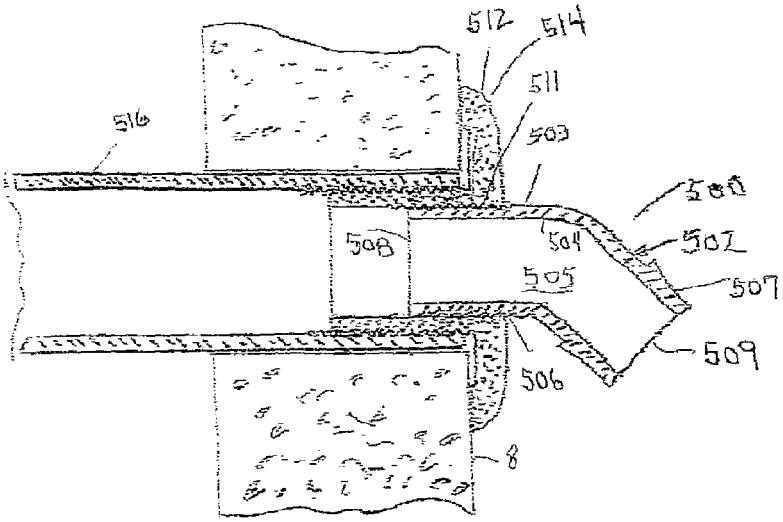
FIG. 8B is an enlarged side sectional view of an exemplary wall fitting in accordance with the invention.

FIGS. 8A and 8B show a wall fitting assembly 500 in accordance with the invention configured to reduce the likelihood of the hose 9 getting stuck as explained with reference to FIGS. 7A and 7B. The wall fitting 500 is comprised of an open tubular member 502 having an outer surface 503 and an inner surface 504 surrounding an interior passageway 505. The wall fitting 500, as shown in FIG. 8B, is comprised of an inlet section 506 and an outlet section 507 extending obliquely therefrom. The inlet section defines an entrance opening 508 and the outlet section 507 defines an exit opening 509. The tubular member 502 is configured for mounting adjacent the containment wall surface 8. FIG. 8B depicts a suitable mounting structure wherein the inlet section 506 is externally threaded at 511 for engagement with internal threads 512 of flanged collar 514 affixed to the end of supply conduit 516. In use, water is supplied from the positive pressure source 10 through conduit 516 into entrance opening 508 and passageway 505 to exit opening 509. The outlet section end is configured for detachable coupling to the hose 9 for supplying water to the cleaner body 6. Significantly, the outlet section 507 extends downwardly at an oblique angle of between 15° and 75°, preferably approximately 45°, relative to the inlet section 506 and the adjacent wall surface 8. The orientation and configuration of the fitting 500 encourages the hose 9 to slide down and off the outer surface of the oblique outlet section 507, rather than being restrained by the fitting as depicted in FIGS. 7A, 7B. Moreover, the oblique orientation of the outlet section 507 provides greater clearance behind the fitting thus reducing the likelihood of the hose 9 being restrained. Although the fitting 500 is particularly advantageous when used with top/bottom pool cleaning systems of the type exemplified by FIG. 1, it is pointed out that the fitting 500 can also be advantageously used with other pool cleaning systems, e.g., top only, bottom only.

Although the present invention has been described in detail with reference to only a limited number of embodiments, those skilled in the art will readily appreciate that various modifications and alternatives can be used without departing from the spirit or intended scope of the invention as defined by the appended claims.

The invention claimed is:

1. Apparatus configured to be driven by a positive pressure water source for cleaning the interior surface of a pool containment wall and the top surface of a water pool contained therein, said apparatus comprising:

a cleaner body configured for travel through said water pool, said body carrying a plurality of nozzles each oriented to discharge a water jet to produce a directed force on said body;

a water distribution subsystem carried by said body including a state valve having an inlet for receiving a water flow from said water source, said state valve being operable in a first state to direct said received water flow to a state valve first outlet and operable in a second state to direct said received water flow to a state valve second outlet;

said water distribution subsystem further including a mode valve having a mode valve inlet and first and second outlets and operable in a first mode to direct a water flow supplied to said mode valve inlet to said mode valve first outlet and in a second mode to direct said supplied water flow to said mode valve second outlet;

said state valve first outlet being coupled to said mode valve inlet for supplying a water flow thereto, said state valve second outlet being coupled to at least one of said nozzles for discharging a water jet for redirecting the direction of travel of said cleaner body;

said mode valve first outlet being coupled to at least one of said nozzles for discharging a water jet to propel said body in a forward direction along said water pool surface and said mode valve second outlet being coupled to at least one of said nozzles for discharging a water jet to propel said body in a forward direction along said containment wall surface;

a controller for selectively switching the states of said state valve and said mode valve; and a turbine having an entrance port coupled to said water source and an exit port coupled to said state valve inlet and wherein said turbine is configured to be rotated by a water flow from said entrance port to said exit port.

2. The apparatus of claim 1 wherein said controller is driven by said turbine.

3. The apparatus of claim 2 further including a first actuator responsive to said controller for switching the state of said state valve.

4. The apparatus of claim 3 further including a second actuator responsive to said controller for alternately switching said mode valve between said first and second modes.

5. The apparatus of claim 4 wherein said controller permits switching of said mode valve only when said state valve is operating in said second state.

6. The apparatus of claim 4 further including an override mechanism for selectively restricting operation of said mode valve to either said first mode or said second mode.

* * * * *